US006435510B2

(12) United States Patent
Moore

(10) Patent No.: US 6,435,510 B2
(45) Date of Patent: Aug. 20, 2002

(54) METHOD OF DEALING A CASINO POKER GAME

(76) Inventor: James Chyvan Moore, 79 San Simeon Dr., Palm Springs, CA (US) 92264

( * ) Notice: Subject to any disclaimer, the term of this patent is extended or adjusted under 35 U.S.C. 154(b) by 0 days.

(21) Appl. No.: 09/871,296

(22) Filed: May 30, 2001

Related U.S. Application Data

(60) Provisional application No. 60/208,509, filed on May 31, 2000.

(51) Int. Cl.[7] ..... A63F 1/00
(52) U.S. Cl. ..... 273/292; 273/274; 273/306
(58) Field of Search ..... 273/292, 274, 273/306

(56) References Cited

U.S. PATENT DOCUMENTS

| | | | | | |
|---|---|---|---|---|---|
| 5,540,444 | A | * | 7/1996 | Nguyen | 273/292 |
| 5,560,613 | A | * | 10/1996 | Nguyen | 273/274 |
| 6,146,271 | A | * | 11/2000 | Kadlic | 273/292 |
| 2001/0048197 | A1 | * | 12/2001 | Lo | 273/292 |

OTHER PUBLICATIONS

John Scaarne Scarne's Encyclopedia of Games, 1817—Harper & Row Publishers pp. 41–43.*

* cited by examiner

*Primary Examiner*—Benjamin H. Layno
*Assistant Examiner*—Dolores R Collins

(57) ABSTRACT

A casino poker game in which two to six players may participate. Each player receives eight cards, one at a time and face up, with which to form a variety of predetermined poker hands. Each player places six basic bets, one for each of six numbered betting circles numbered one through six. Each circle creates a primary pool for six different classes of poker hands: any low pair of eights or less, any high pair of nines or less, any three of a kind or straight, any flush or full house, any four of a kind or straight flush, and jack high straight flush or higher Each of the six primary pools of one through six is designated for each of the six classes of poker hands. The first player to make a hand corresponding to a given circle will be awarded the primary pool in that circle. Each primary pool that is unclaimed will be placed in a reserve pool identifiable with the circle from which it comes. The reserve pools will carry over to succeeding hands until won. Players may win 50% of the largest unclaimed reserve pool at the end of a given 24 hour period by making highest hand during that period. Any player may play two hands if an adjacent circle is vacant and thereby becomes eligible to win any pool with either of the two hands.

4 Claims, No Drawings

METHOD OF DEALING A CASINO POKER GAME

This application claims priority from provisional application Ser. No. 60/208,509, filed May 31, 2000.

BACKGROUND OF THE INVENTION

For many years poker players throughout the world have participated in casino poker games. Most games to date have had common features such as having two to five betting intervals as additional cards are dealt to the players, each player being required to call all bets or forfeit any chance to win the monetary pot being created by all such bets.

Players can often be extremely aggressive in betting and raising the pot in an attempt to force other players to fold and forfeit their chance to win. Because of this, hostilities frequently arise between players.

Through the years many poker players develop their skills to a high level, causing newcomers to the game to enter a game with extreme caution. Many never summon the courage to enter a live casino poker game at all, though many wistfully desire to do so.

This poker game addresses this problem by requiring only one bet from each player to start the hand, with that single bet allowing every player to play every hand to the end and thereby always being eligible to win any poker pool.

This creates a much more congenial game for all players, making it a much more attractive game for new players, since they can enter a game and relax, knowing they can play on equal terms with any other player at the table.

Unlike existing poker games, any player may play two hands against the others at any time an adjacent seat is vacant. This factor tends to keep the pots bigger and also helps to make the game easier to start and less effort to keep the game going.

Every player entering the casino now has an opportunity to play a live poker game with complete confidence in being able to play as well as anybody, thereby bringing many more casino patrons through the doors of the poker room.

BRIEF SUMMARY OF THE INVENTION

A casino poker game in which two to six players strive to make any of the six predetermined poker hands more quickly than the others. Each player receives an eight card poker hand one card at a time and face up. There are six different primary pools to be won, with each player placing one bet in each pool at the start of the hand. Pools are numbered from one through six.

The first player to make any of the six hands is awarded the primary pool for that hand. If any primary pool remains after all players' hands are complete, it will be placed in a reserve pool. The reserve pools are numbered to match the primary pools.

The reserve pools can be won by the first player to make the proper hand in succeeding rounds of play. Once a day, 50% of the largest unclaimed reserve pool can be won by the player receiving the highest hand during the preceding 24 hour period.

Any player may place a bet on any adjacent circle if that seat is vacant. That qualifies the player to play two separate hands. Either hand can be used to win any primary and reserve pools.

Any reserve pools are carried over to all succeeding hands until won.

DETAILED DESCRIPTION OF THE INVENTION

A casino poker game played on a regular casino poker table with six betting circles numbered one through six to accommodate up to six players.

Each player places six basic bets or one for each betting circle. Each circle will be designated for specific poker hands as follows:

Circle one will be designated for low pairs of eight or less.

Circle two will be designated for high pairs of nine or more.

Circle three will be designated for any three of a kind or straight.

Circle four will be designated for any flush or full house.

Circle five will be designated for any four of a kind or straight flush.

Circle six will be designated for any jack high straight flush or higher.

The dealer, using a standard deck of 52 playing cards, will deal one card at a time face up to each player in rotation until each player has a total of eight cards with which to form any of the six specific hands listed above.

The first player to form any of the six designated hands will be awarded the primary poker pool in that corresponding circle.

After all eight card hands are complete, the dealer will place any unclaimed primary pools into a reserve pool with a number matching the circle from which that pool came.

Reserve pools will remain in reserve until a player wins with an appropriate hand and is awarded both the primary pool and the reserve pool. All players are eligible to all pools they may qualify for with any of their eight cards.

Individual high hands will be posted throughout a given 24 hour period, with the highest hand being awarded 50% of the largest reserve pool at the end of that 24 hour period.

All reserve pools will be carried over to all succeeding hands until a player wins with the appropriate hand.

Any player may play 2 hands any time an adjacent seat is vacant by placing the required bet in the vacant circle. This qualifies the player to win any and all pools with either of his 2 hands.

What is claimed is:

1. A method of dealing a casino poker game comprising the steps of:

Providing one conventional deck of 52 cards, each card having a numerical or rank value in four standard suits of spades, hearts, diamonds and clubs;

providing a playing board having a dealer area and having a plurality of designated player areas;

assigning the dealer area to the dealer, and assigning one or two designated areas to each player of the plurality of players;

each player's designated area consisting of a circle for each player to place six basic bets;

one bet being for each of the six designated circles numbered one through six;

the bets in each circle being designated primary poker pools to be won with specific types of poker hands;

circle one being designated for low pairs of eight or less;

circle two being designated for high pairs of nine or more;

circle three being designated for any three of a kind or straight;

circle four being designated for any flush or full house;

circle five being designated for any four of a kind or straight flush;

circle six being designated for any jack high straight flush or higher;

the dealer then dealing eight cards face up and one at a time to each player at their designated area;

the player to first form any of the six designated poker hands being awarded the primary poker pool corresponding to that designated poker hand;

the dealer proceeding to award each primary poker pool as it is won, until each player's eight card hand is complete and each primary poker pool has been properly awarded to each winning player.

2. The method of dealing a casino poker game according to claim 1, further comprising the steps of:

the dealer determining any unclaimed primary poker pools at the end of each hand;

placing any such primary pool into one of six designated reserve pools;

each reserve pool being numbered one through 6 to correspond with each numbered primary pool;

with reserve pools to remain in reserve until a player wins both the primary pool and the reserve pool with an appropriate poker hand;

with player then being awarded both the primary pool and the reserve pool;

3. The method of dealing a casino poker game according to claim 1, further comprising the steps of:

the casino posting players high hands for each day throughout a given 24 hour period;

with the high hand of the day being warded 50% of the largest unclaimed reserve pool at the end of the given 24 hour period;

further allowing the remainder of that reserve pool, along with all other reserve pools to be carried over to all succeeding hands;

awarding each reserve pool to any player making a poker hand corresponding to that specific reserve pool.

4. The method of dealing a casino poker game according to claim 1, further comprising the steps of:

permitting any player, of the plurality of players, to play two hands by placing the required additional bets in any adjacent circle unoccupied by any other player;

such player then becoming eligible to win any poker pool available with either one of the two hands being played.

* * * * *